US010548403B2

(12) United States Patent
Willins

(10) Patent No.: US 10,548,403 B2
(45) Date of Patent: Feb. 4, 2020

(54) INTERIOR DECORATING KIT WITH INTERCHANGEABLE DECORATIONS AND ELEMENTS AND METHOD OF USE

(71) Applicant: Patsy A. Willins, Raytown, MO (US)

(72) Inventor: Patsy A. Willins, Raytown, MO (US)

( * ) Notice: Subject to any disclaimer, the term of this patent is extended or adjusted under 35 U.S.C. 154(b) by 318 days.

(21) Appl. No.: 15/137,890

(22) Filed: Apr. 25, 2016

(65) Prior Publication Data

US 2016/0309925 A1 Oct. 27, 2016

Related U.S. Application Data

(60) Provisional application No. 62/151,756, filed on Apr. 23, 2015.

(51) Int. Cl.
*G09B 25/00* (2006.01)
*A47C 7/62* (2006.01)

(52) U.S. Cl.
CPC ..... *A47C 7/386* (2013.01)

(58) Field of Classification Search
USPC ..... 434/72, 73, 75, 79, 81, 96, 97, 98; D6/580, 610, 611, 612, 617
See application file for complete search history.

(56) References Cited

U.S. PATENT DOCUMENTS 2,500,074 A * 3/1950 Hill ..... A47H 23/02 160/123
3,010,670 A * 11/1961 Jones ..... A47K 10/38 242/560
4,631,765 A * 12/1986 Casey ..... A47G 9/0207 428/33
4,875,245 A * 10/1989 Isola ..... A47G 9/02 5/482
5,191,922 A * 3/1993 Wade ..... A47H 13/00 160/124
5,203,395 A * 4/1993 Koller ..... A47H 23/02 160/121.1
5,778,802 A * 7/1998 Hairston ..... A47G 11/006 108/90
5,887,298 A * 3/1999 Semidey ..... A47K 10/025 4/242.1
5,894,876 A * 4/1999 O'Brien ..... A47H 23/04 160/124
6,192,962 B1 * 2/2001 Glover ..... A47H 2/02 160/126
6,202,956 B1 * 3/2001 Grasso ..... A47K 10/3836 242/560
6,854,596 B1 * 2/2005 Wiese ..... A47K 10/22 206/225

(Continued)

*Primary Examiner* — Kurt Fernstrom
(74) *Attorney, Agent, or Firm* — Law Office of Mark Brown, LLC; Christopher M. DeBacker

(57) ABSTRACT

A home interior decorating kit with multiple interchangeable decorative elements for temporary attachment to multiple home interior items such as table runners, chair back covers, decorative pillows, towels, curtains, and tissue boxes. Each of the home interior items includes a connection area for receiving one or more decorative elements. These elements are entirely interchangeable, providing a highly customizable home interior decoration kit. The decorative elements can be attached to the home interior items using hook-and-loop fasteners, buttons, snaps, zippers, or any suitable connection type.

11 Claims, 13 Drawing Sheets

(56) References Cited

U.S. PATENT DOCUMENTS

| | | | | |
|---|---|---|---|---|
| 7,083,138 | B2 * | 8/2006 | Elliott | A47K 10/38 242/560 |
| 7,650,924 | B1 * | 1/2010 | Bouldin | A47H 1/00 160/330 |
| 7,726,515 | B2 * | 6/2010 | Sherman | B65D 5/16 221/302 |
| D632,916 | S * | 2/2011 | Pitzer | D6/617 |
| 8,047,256 | B2 * | 11/2011 | Zimmer | A47H 13/04 160/124 |
| 8,262,039 | B2 * | 9/2012 | Royka | A47G 11/003 248/205.3 |
| 8,695,914 | B2 * | 4/2014 | Mohr | B65D 85/672 242/588.6 |
| 9,016,349 | B2 * | 4/2015 | Seitz | A47H 13/00 160/123 |
| 9,113,739 | B2 * | 8/2015 | Thomas | A47H 2/00 |
| D781,067 | S * | 3/2017 | Cross | D6/520 |
| 2002/0007920 | A1 * | 1/2002 | Lower | A47H 23/02 160/38 |
| 2005/0011618 | A1 * | 1/2005 | Kee | A47G 9/0284 160/179 |
| 2007/0257532 | A1 * | 11/2007 | Bukowski | A47C 31/11 297/219.1 |
| 2008/0145594 | A1 * | 6/2008 | Jewell | A47G 27/0268 428/100 |
| 2010/0051214 | A1 * | 3/2010 | Daly | A44B 19/262 160/368.1 |
| 2011/0017104 | A1 * | 1/2011 | DiTrolio | A47G 11/006 108/50.11 |
| 2011/0168340 | A1 * | 7/2011 | Squillante | A47H 2/00 160/330 |
| 2016/0235201 | A1 * | 8/2016 | Soot | F21V 33/0012 |

* cited by examiner

INTERIOR DECORATING KIT WITH INTERCHANGEABLE DECORATIONS AND ELEMENTS AND METHOD OF USE

CROSS-REFERENCE TO RELATED APPLICATION

This application claims priority in U.S. Provisional Patent Application No. 62/151,756, filed Apr. 23, 2015, which is incorporated herein by reference.

BACKGROUND OF THE INVENTION

1. Field of the Invention

The present invention relates generally to a system and method for a home decorating kit, and more specifically to an interchangeable home decorating system and method of use which includes, but is not limited to: pillows, throws, table runners, placemats, tissue holders, towels, bathroom accessories, chair back covers, shades, curtains, etc.

2. Description of the Related Art

Existing home décor items are essentially static in their patterns and decorations. This means that a homeowner would have to purchase multiple different sets if they wish to update or transition their home décor theme between seasons, for holidays, or simply on a whim. This can be expensive and also requires storage space for so many different items.

What is needed is home décor which assists consumers in decorating their living environments with a kit or set of décor items. The home décor items that currently exist are usually sold separately. What is needed is a solution for consumers that have limited decorating abilities by providing a simple, single purchase kit or set that can be used to change or transform a room.

Heretofore there has not been available a system or method for interchangeable components for home décor items with the advantages and features of the present invention.

BRIEF SUMMARY OF THE INVENTION

The present invention generally provides interchangeable and detachable fringe, trims, covers and extensions for alternate designs. A preferred embodiment of the present invention includes a set of multiple décor items including alternate designs, which utilize attachable/detachable agents such as Velcro, snaps, magnets, hooks and eyes, zippers, buttons, or other suitable connection types.

The present invention could embody a single home interior item with multiple interchangeable decorative elements as provided in the examples below, or it could employ two or more of these embodiments in a single kit with several options for decorative elements.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

The present invention primarily would include a decorating kit with sets of multiple décor items with alternate uses or designs. The components can be attached and detached using Velcro®, snaps, magnets, hooks and eyes, zippers, etc. The invention sets may be used for every room of the home and may include, but are not limited to: 2 pillows and a throw; a table runner and 2 placemats (option to purchase additional placemats); 2 bath towels and a tissue holder (may be an individual, double or tri-holder); a tissue holder (may be an individual, double or tri-holder), a tooth brush container and a cotton ball container; 2 pillows and bed throw; a kitchen mitt and 2 kitchen towels; 2 chair back covers and table runner; 2 hand towels and a bath towel, etc.

The most important concept of the present invention is an interchangeable set of decorative elements to be used on several home interior components, including towels, curtains, pillows, tables, and chairs.

II. First Embodiment Interior Decorating Kit 2

Figure 1:
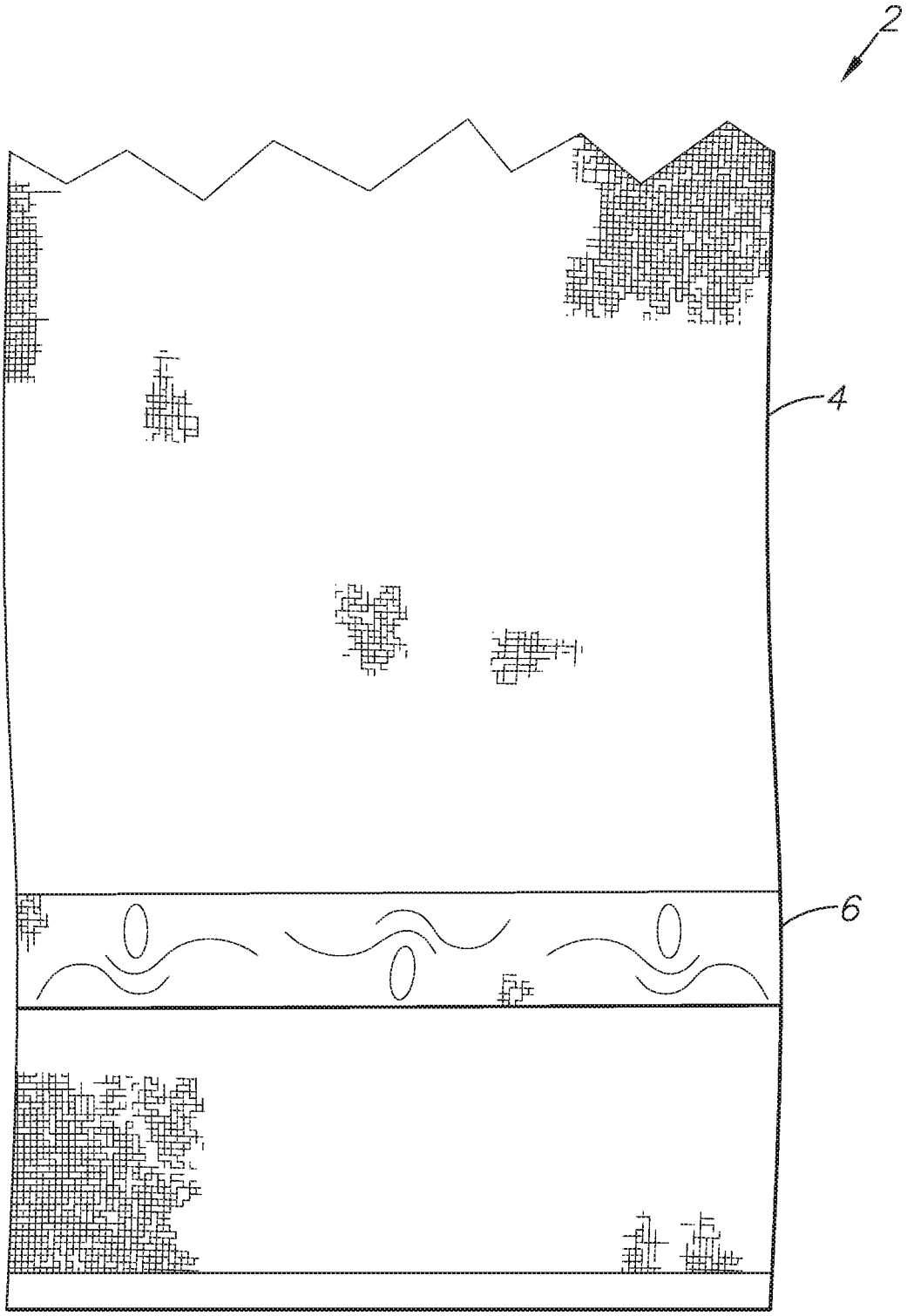
FIG. 1 is a front elevational view of an embodiment of the present invention showing a towel having a removable ornamentation attached.
Figure 2:
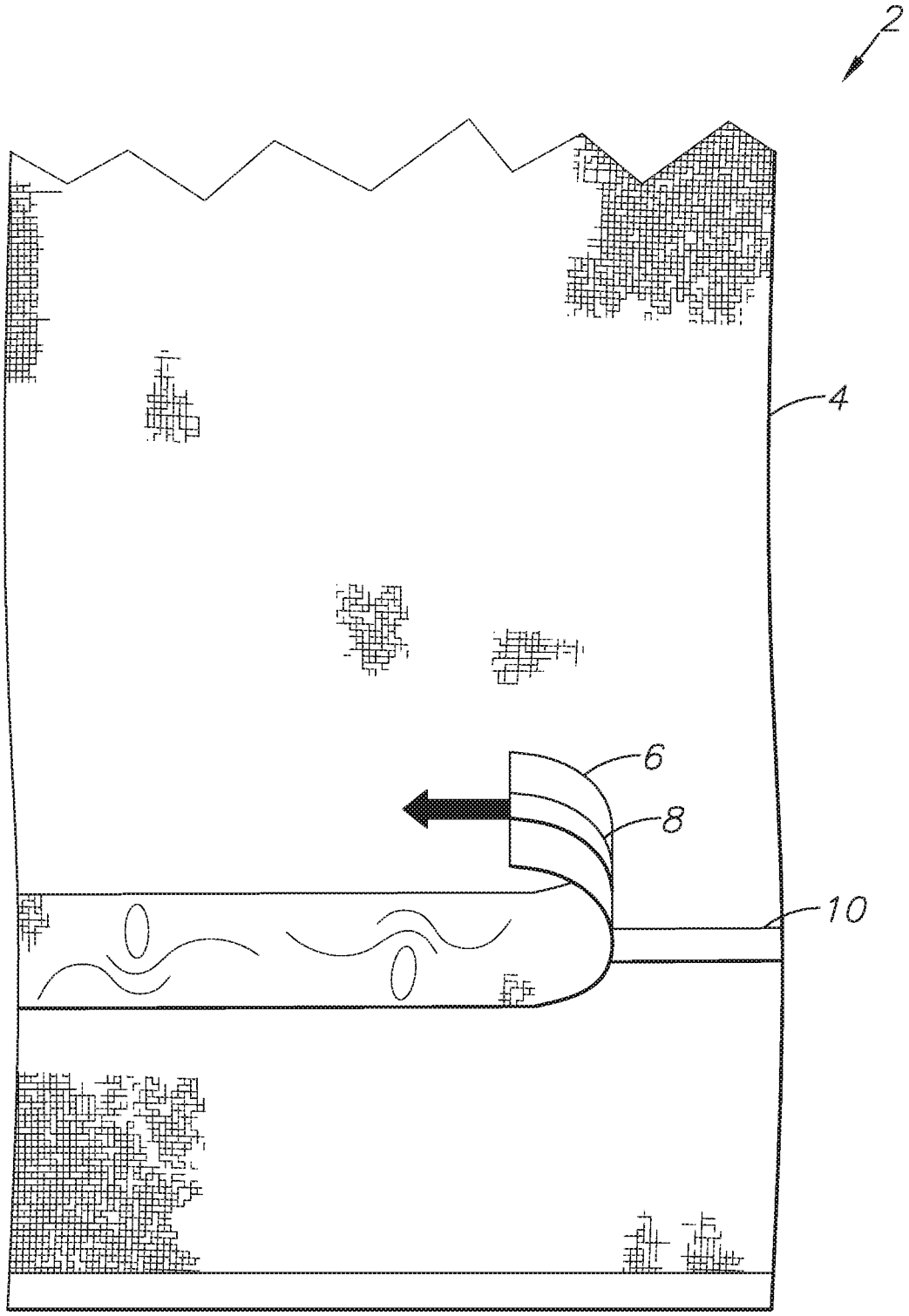
FIG. 2 is a front elevational view thereof showing the ornamentation being removed.
Figure 3:
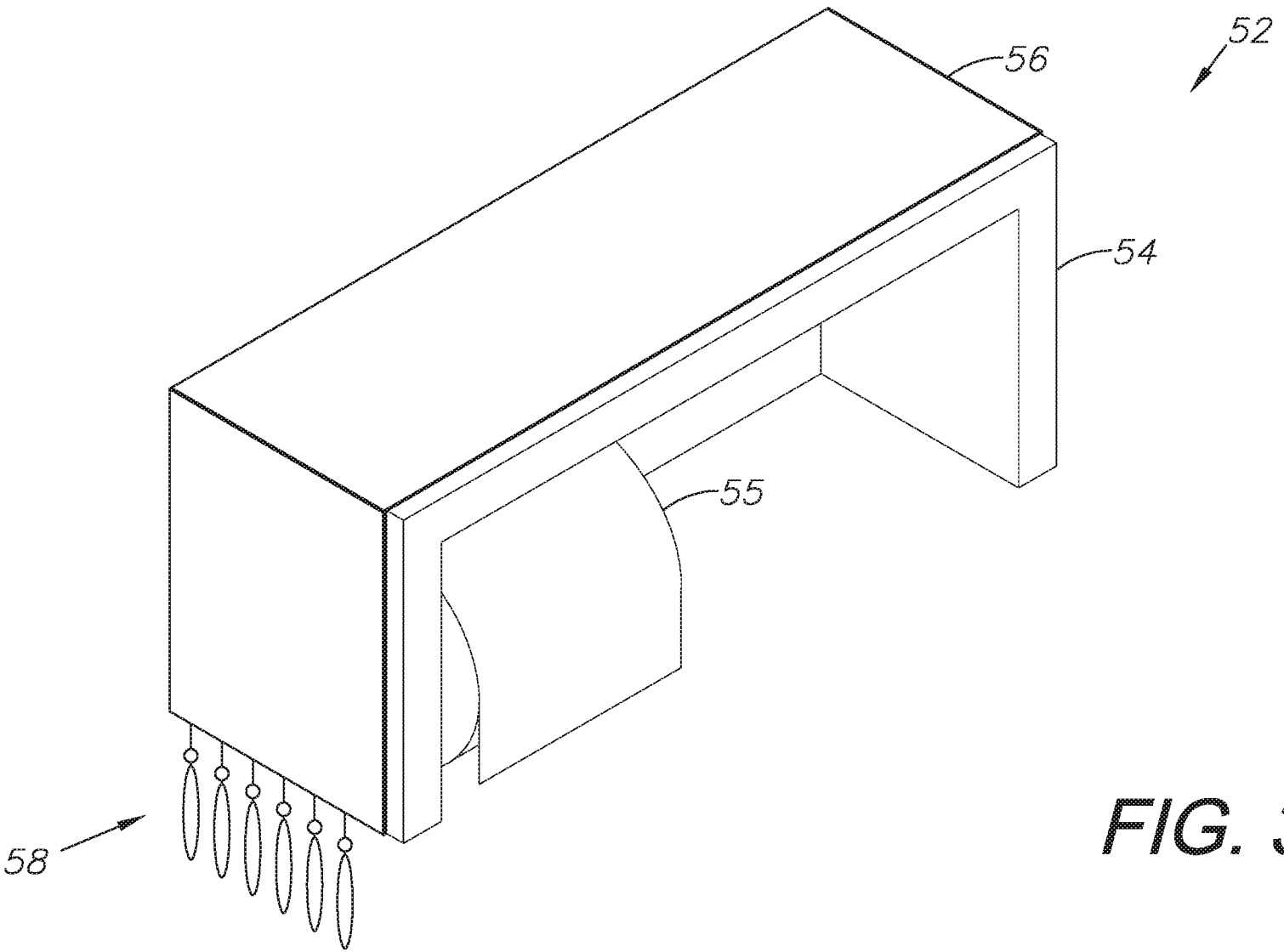
FIG. 3 is a rear three-dimensional isometric view of a toilet roll holder with a cloth cover and detachable ornamentation.

Referring to the figures in more detail, FIGS. 1 and 2 show a first example of an interior decorating kit 2 including a towel 4 having a connection area 10 and a removable decorative element 6 with a corresponding connection area 8. In a preferred embodiment, these corresponding connection areas 8, 10 are made of hook-and-loop fasteners such as Velcro®. However, any of the connecting elements mentioned above would be suitable. The kit would include multiple interchangeable decorative elements 6 which can be taken off and replaced at the user's discretion. These decorative elements 6 would also be interchangeable amongst the other embodiments of the interior decorating kits disclosed below.

III. Second Embodiment Interior Decorating Kit 52

Figure 4:
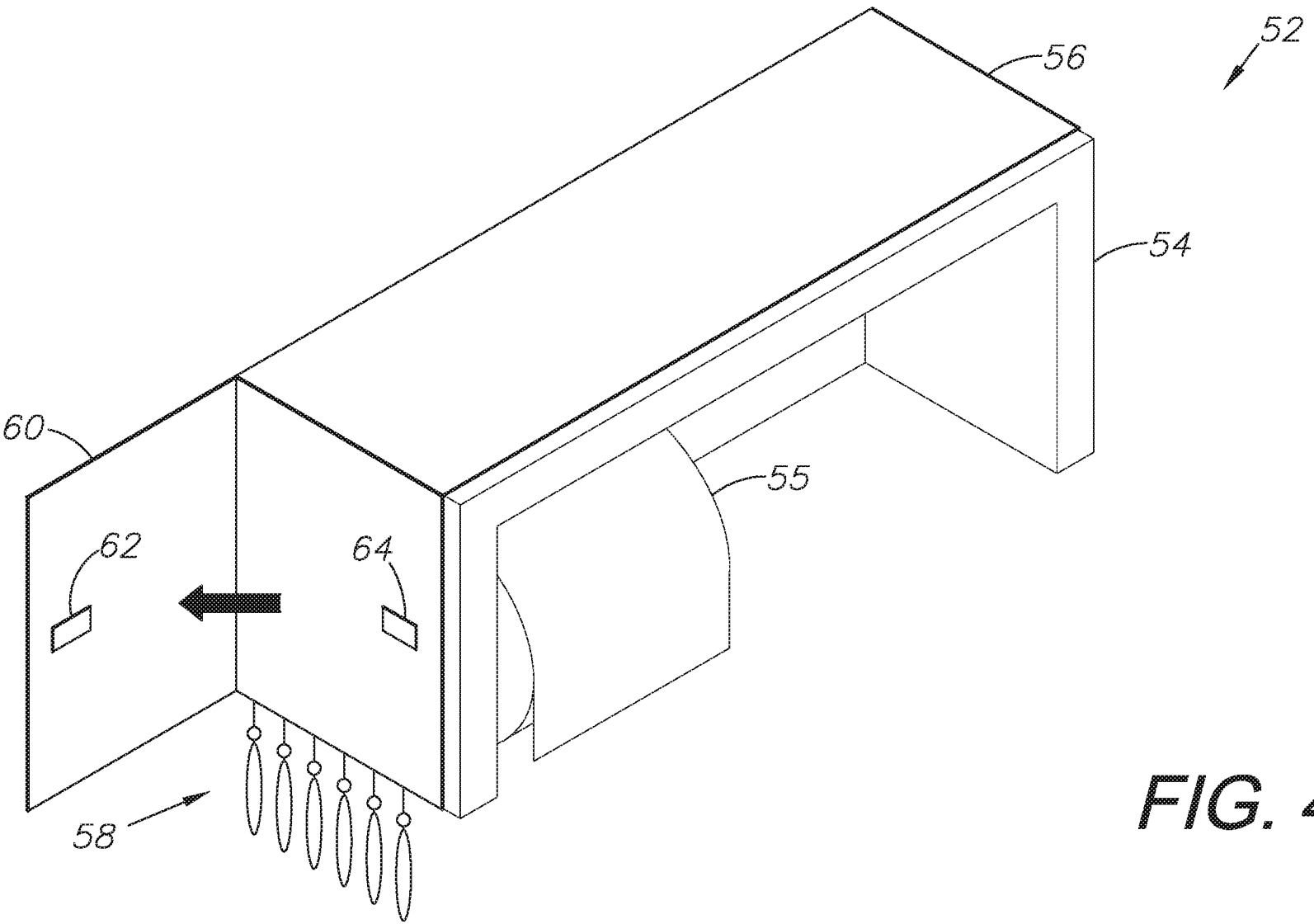
FIG. 4 is another rear three-dimensional isometric view thereof, showing the cloth cover being removed.
Figure 5:
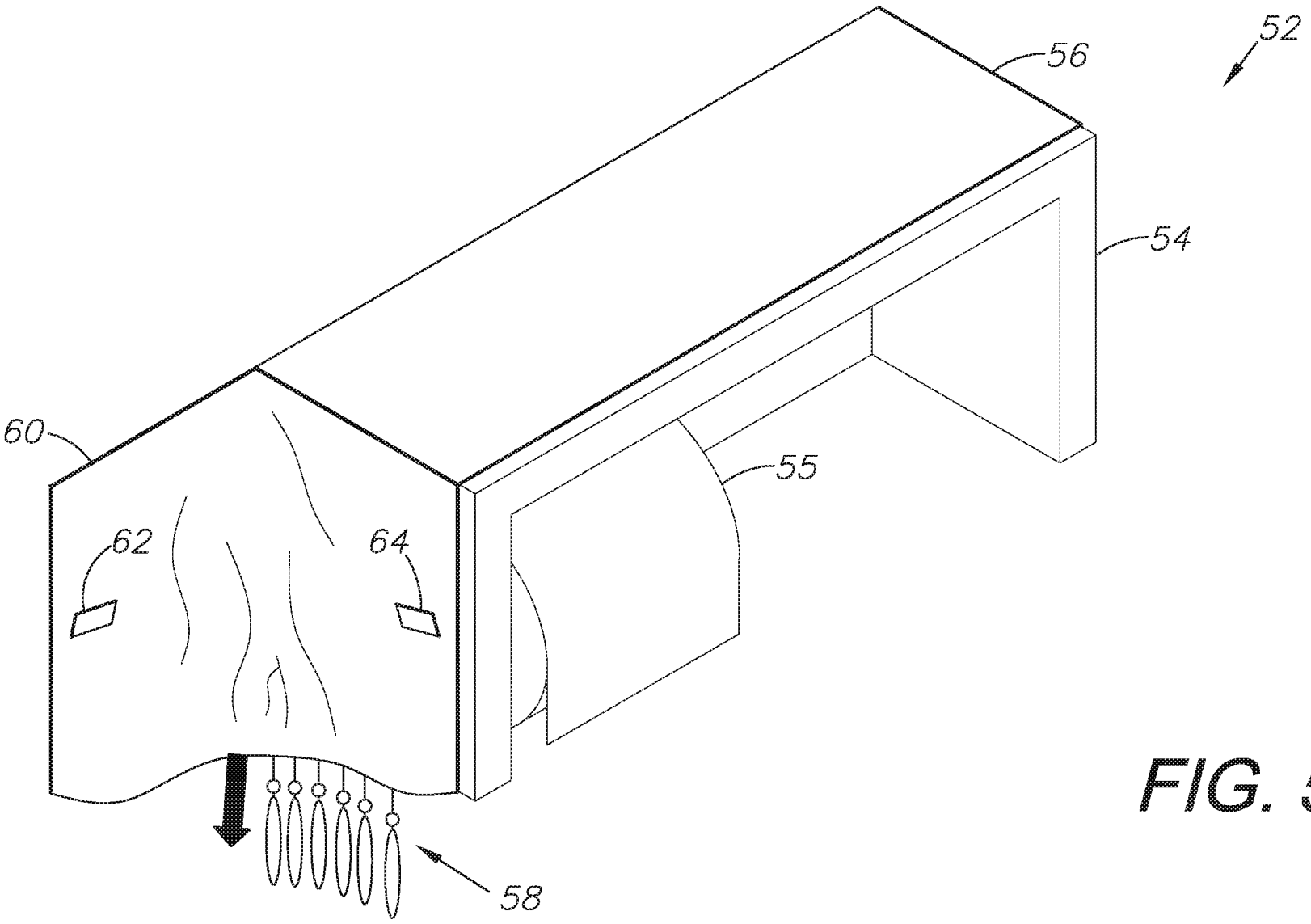
FIG. 5 is yet another rear three-dimensional isometric view thereof, showing the cloth cover being removed.

FIGS. 3-7 show a second example of an interior decorating kit 52 here including a cover 56 for a tissue box 54 which may store a tissue roll 55 or other items including toiletries. The cover 56 may include decorative beads 58 or other decorative elements which hang or dangle from the cover 56. As shown in FIGS. 4 and 5, the cover is easy to remove by detaching a side panel 60 from the body of the cover, where it is typically secured by a first 62 and second 64 attachment device, here shown as hook-and-loop fasteners. The panel unfolds away from the rest of the cover, and opens so that the cover can be removed from the box.

Figure 6:
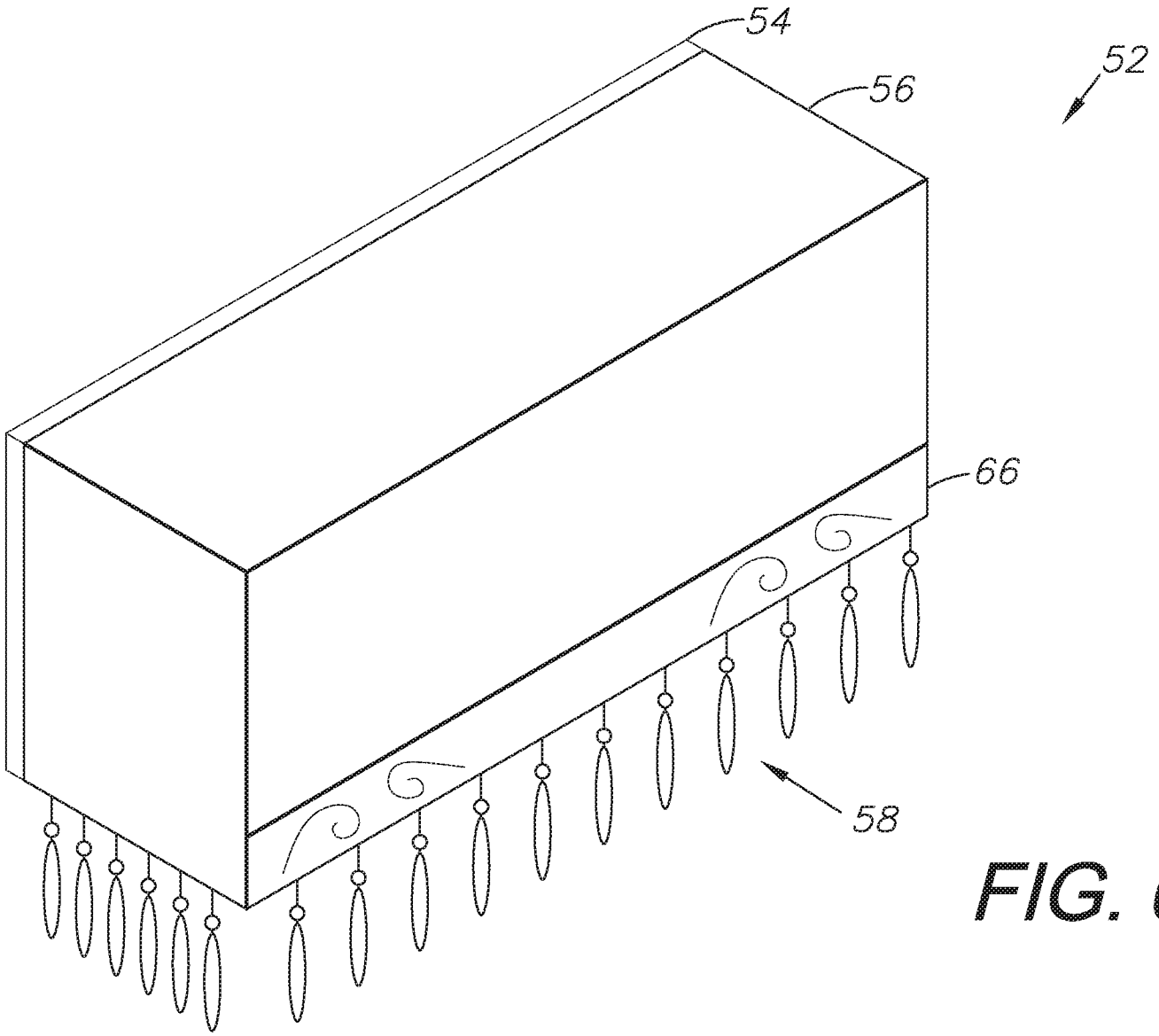
FIG. 6 is a front three-dimensional isometric view thereof, showing an ornamentation.
Figure 7:
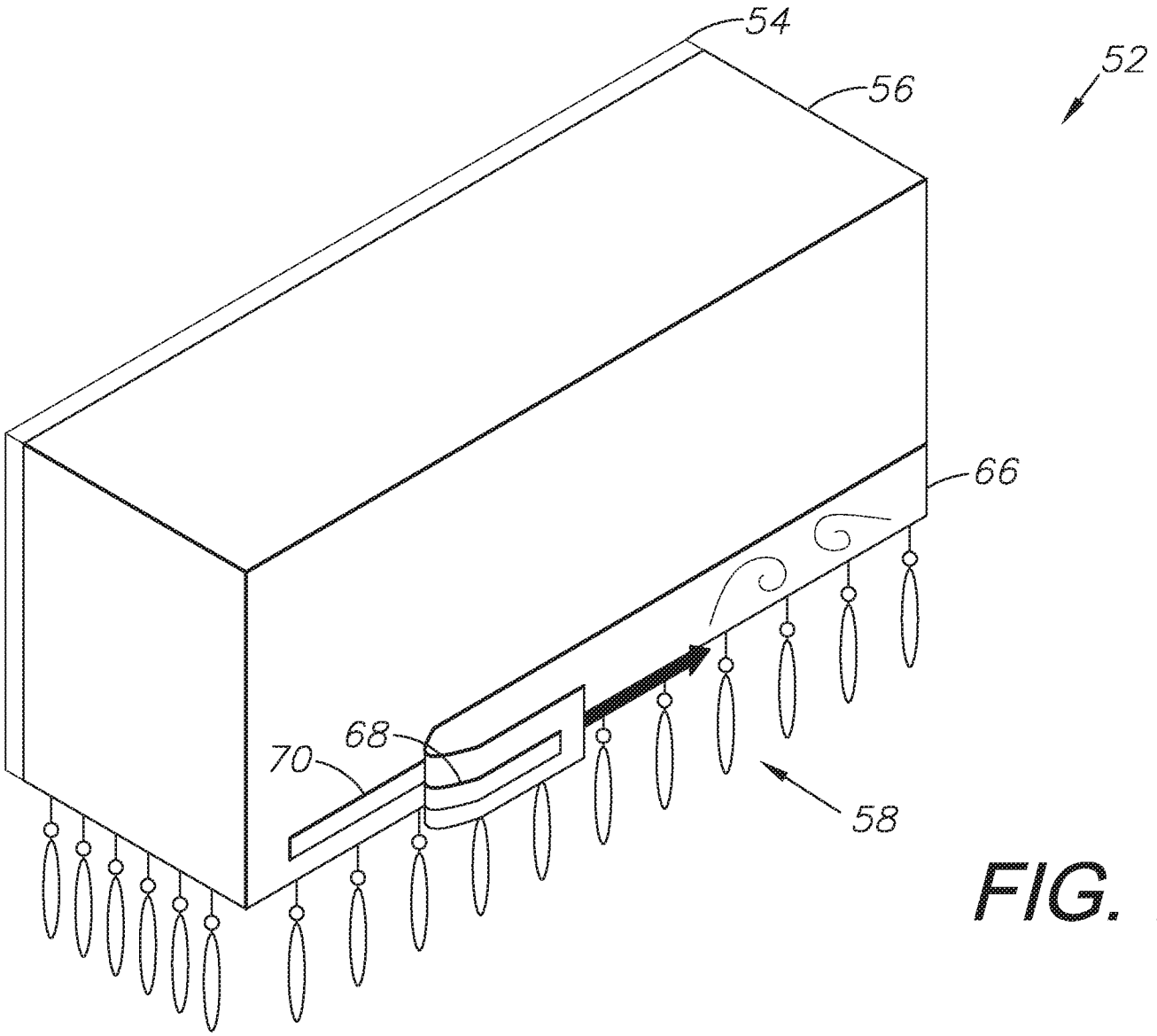
FIG. 7 is another front three-dimensional isometric view thereof, showing the ornamentation being removed.

FIGS. 6 and 7 show a detachable decorative element 66 secured to the cover 56 by a corresponding cover connection area 70 and decorative element connection area 68 similar to the embodiment discussed above for the first embodiment interior decorating kit 2. The decorative element 66 could be interchangeable with the decorative element 6 of that first embodiment. In this way, the user can customize and update all of the items in their home with matching or complimenting decorative flourishes.

IV. Third Embodiment Interior Decorating Kit 102

Figure 8:
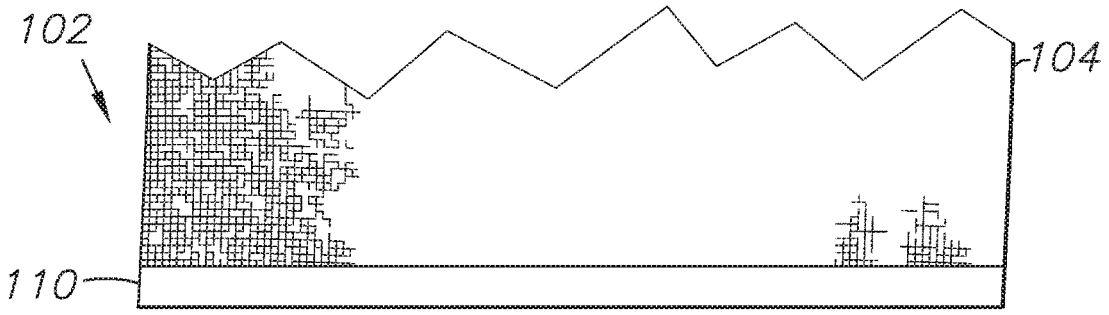
FIG. 8 is a front elevational view of another embodiment of the present invention including a detachable ornamentation along a bottom edge thereof.
Figure 9:
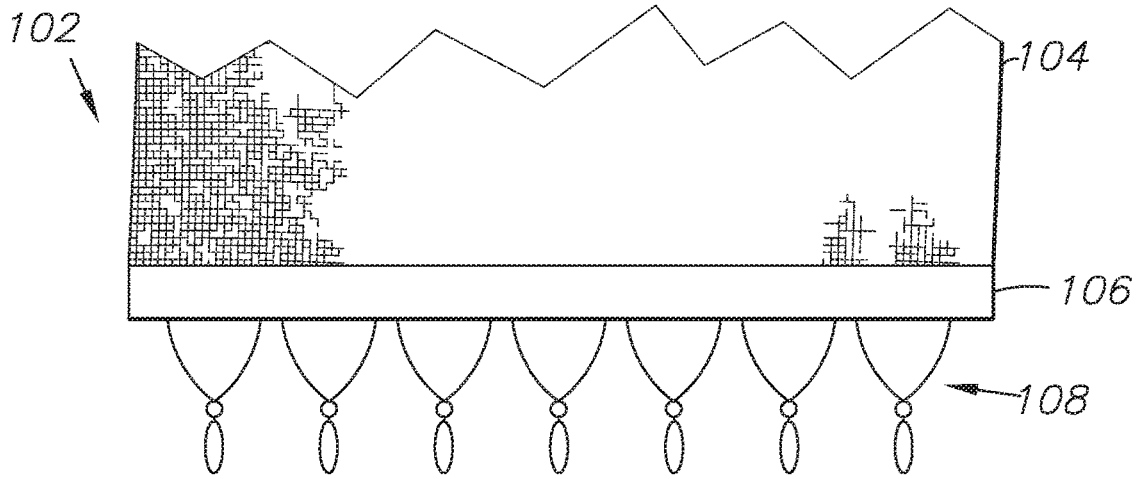
FIG. 9 is another frontal elevational view thereof, showing a second ornamentation.
Figure 10:
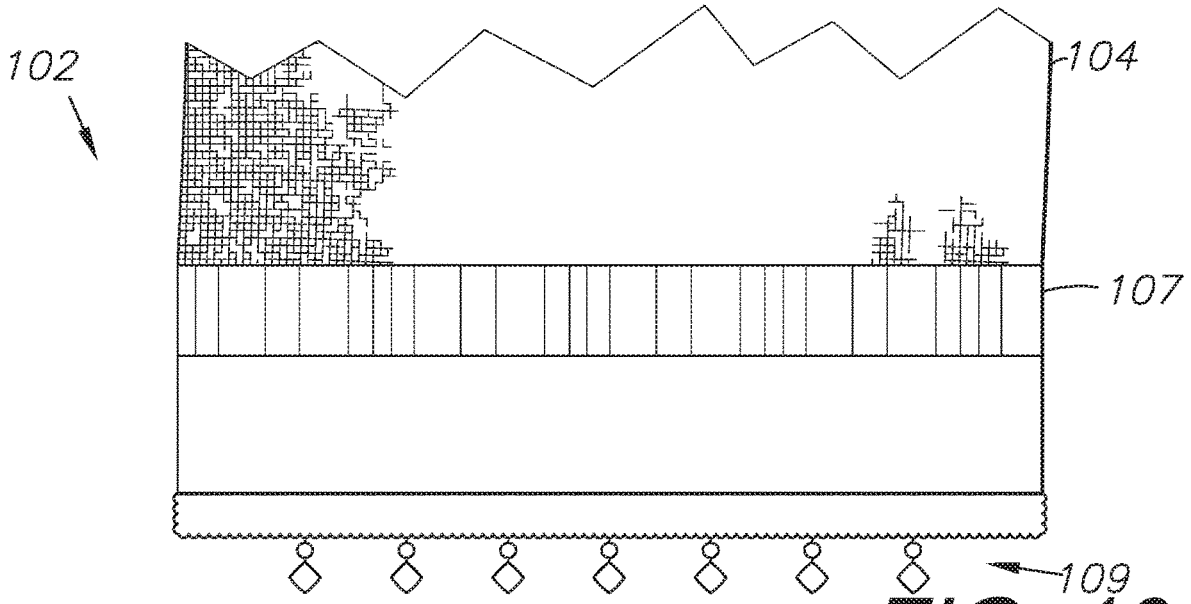
FIG. 10 is yet another frontal elevational view thereof, showing a third ornamentation.

FIGS. 8-10 show a third embodiment interior decorating kit 102 which shows an end of a cloth item 104, such as a table runner, which similar to the first embodiment interior decorating kit 2 has a detachable decorative element 106 including dangling features 108 meant to be decorative. This detachable decorative element connects to the connection area 110 of the cloth item 104 in the same manner as the previously described embodiments. FIG. 10 shows how the decorative element 106 can be replaced with a second decorative element 107, thereby updating the same cloth item 104 with a new look. FIG. 10 also shows a second dangling element 109 meant to be decorative and associated with the second decorative element 107. As shown in FIG. 9, a first decorative element 106 has a first length, and it can be swapped out with a second decorative element 107 which has a second length.

V. Fourth Embodiment Interior Decorating Kit 152

Figure 11:
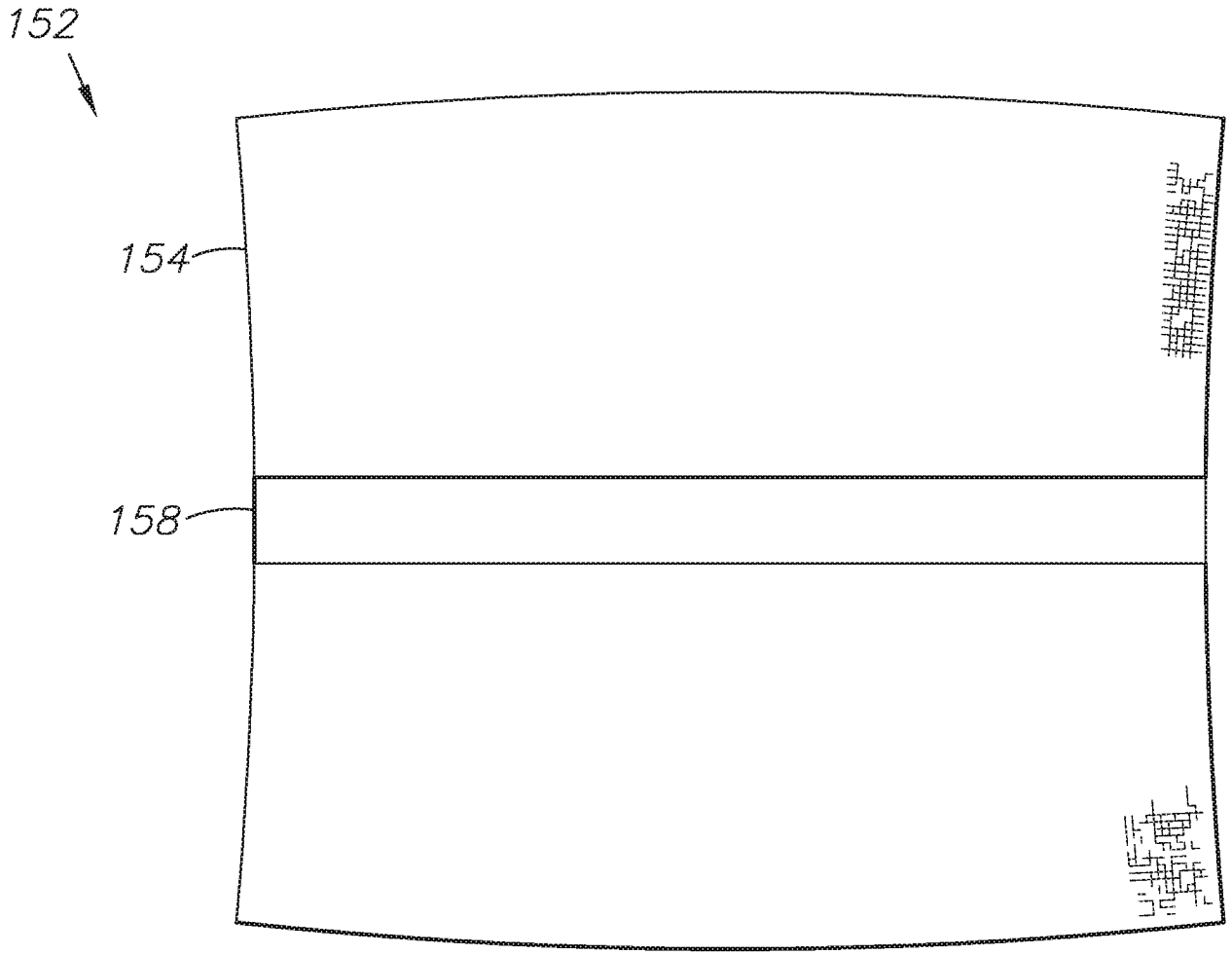
FIG. 11 is a top plan view of a pillow as an embodiment of the present invention including an ornamentation attachment area.
Figure 12:
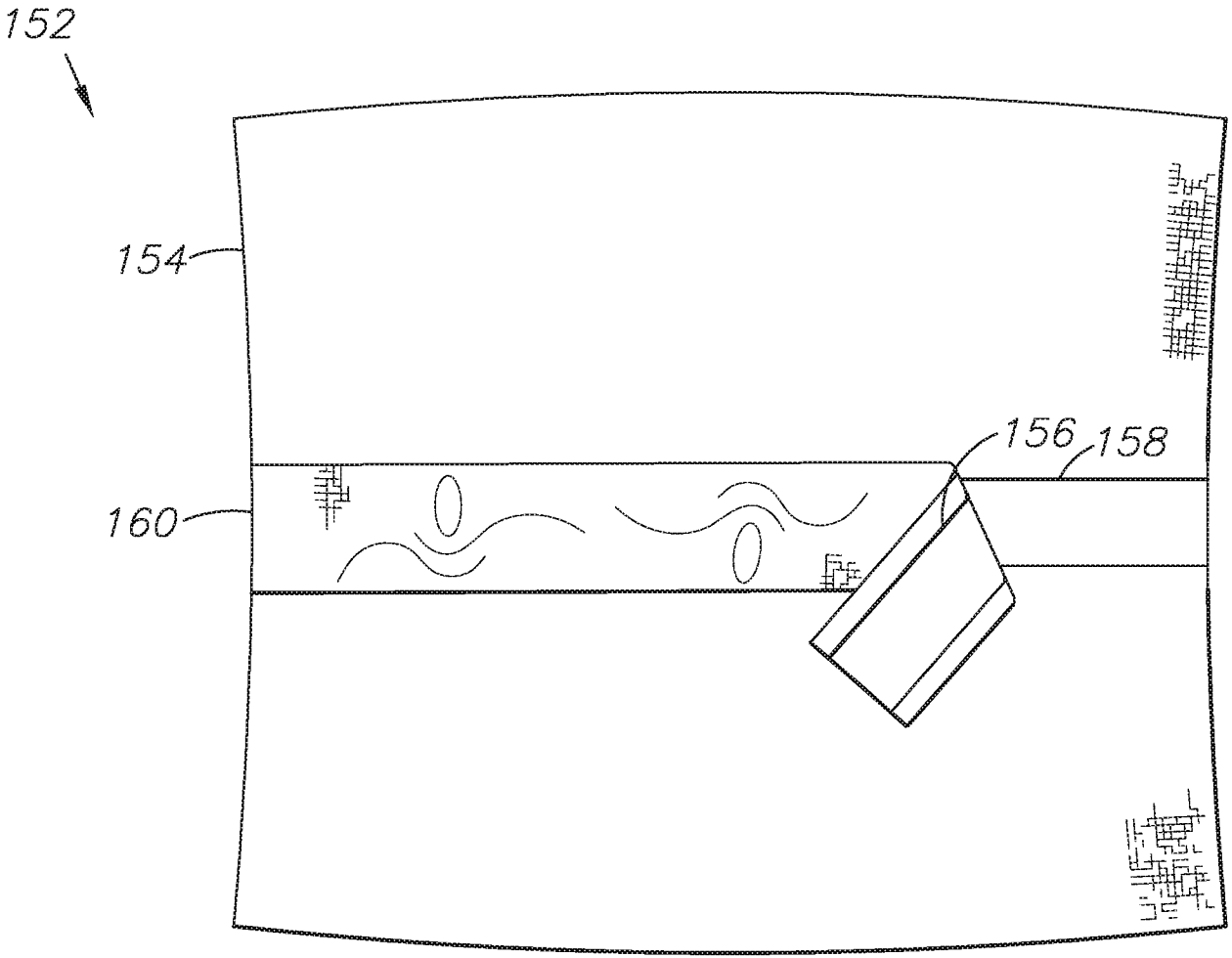
FIG. 12 is another top plan view thereof including an attachable ornamentation.

FIGS. 11 and 12 show another embodiment of an interior decorating kit 152 including a decorative pillow 154 with a connection area 158. A decorative strip 160 similar to those disclosed above and even interchangeable with those disclosed above includes a corresponding connection area 156. As before, these connection areas 156, 158 are preferably hook-and-loop fasteners, but could include other connections such as snaps, buttons, ties, or any suitable temporary fastener. The reverse side of the pillow 154 could have another mirrored connection area 158 and another decorative strip 160 identical to or different from the one shown on this face of the pillow. Additional decorative elements could be attached to other areas of the pillow, such as on the corners. These could include tassels, beads, or other interchangeable decorative elements.

VI. Fifth Embodiment Interior Decorating Kit 202

Figure 13:
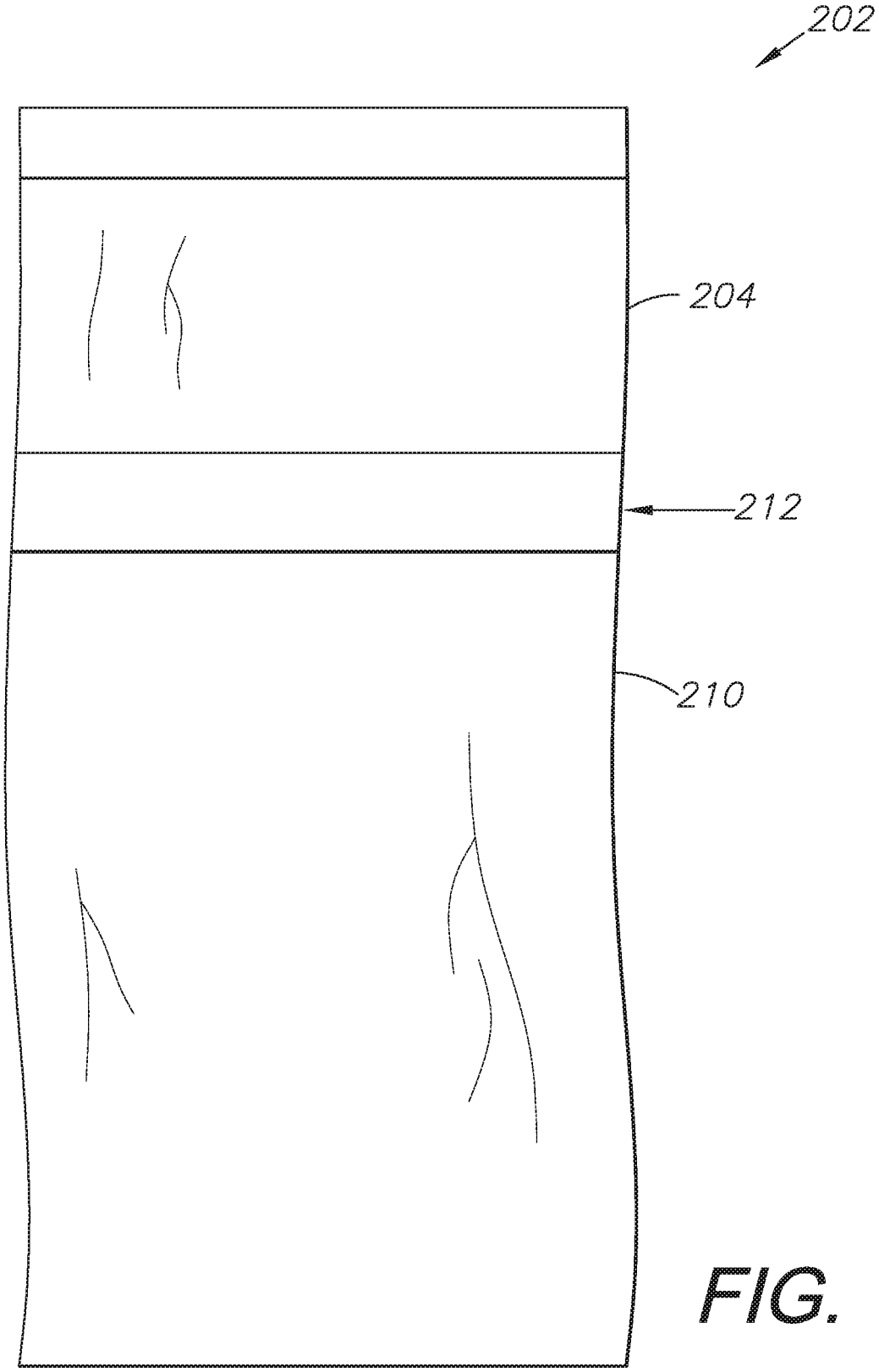
FIG. 13 is a front elevational view of yet another embodiment of the present invention showing a window shade having a detachable portion.
Figure 14:
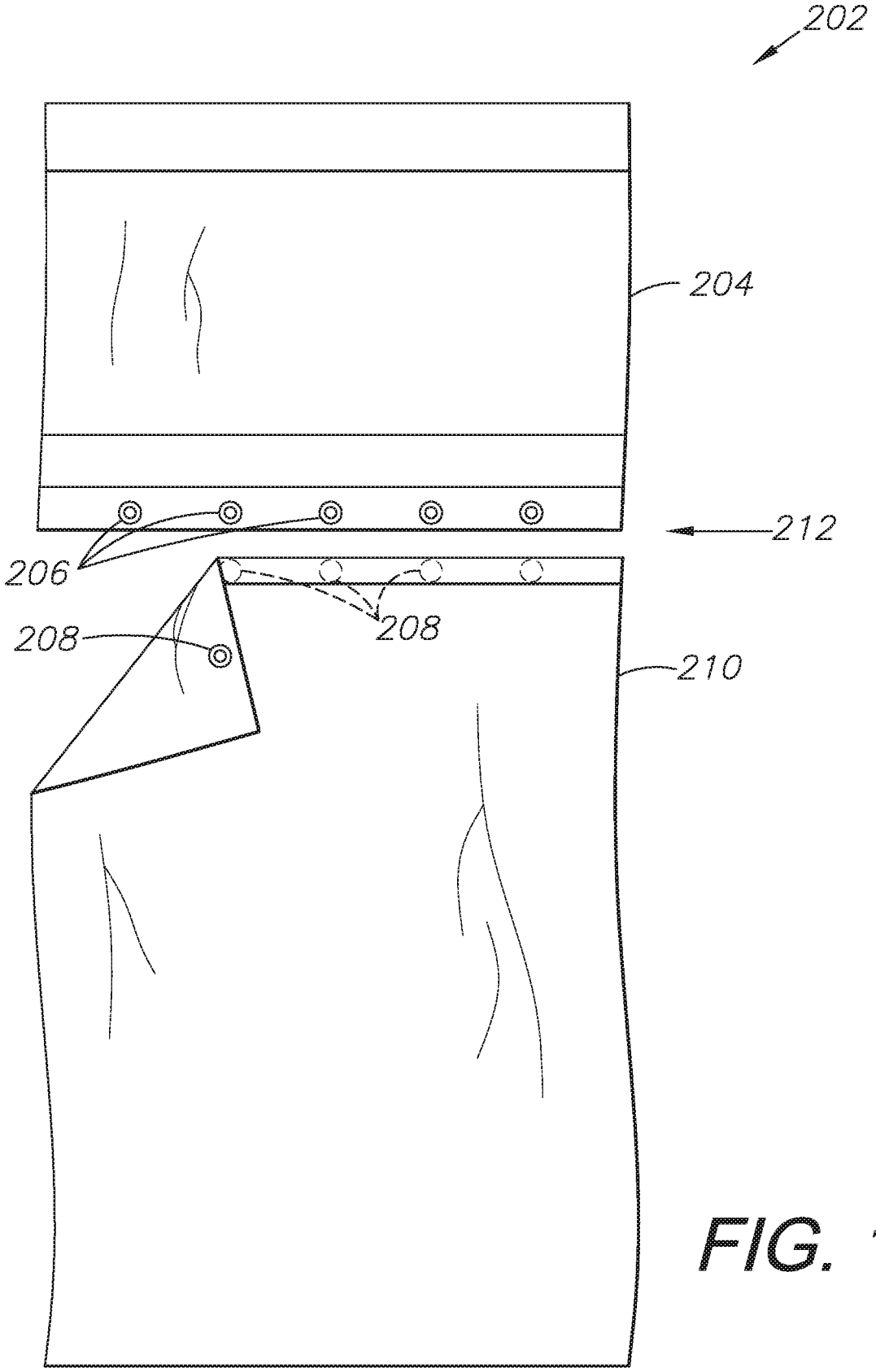
FIG. 14 is a rear elevational view thereof shown in a detached state.

FIGS. 13 and 14 show a fifth embodiment of an interior decorating kit 202. Here, a window shade or curtain is shown with a top potion 204 and a bottom portion 210 with a connection zone 212 connecting the two pieces. As shown in FIG. 14, the bottom portion 210 is connected to the top portion 204 with snaps. Snap receivers 206 are shown on the top portion 204, while snap inserts 208 are shown on the bottom portion 210. These arrangements could be reversed with the inserts being on the top portion and the receivers on the bottom portion. As above, other connection elements could be used instead of snaps, such as hook-and-loop fasteners, ties, buttons, or hooks.

Similar to the above embodiments, additional connection areas could appear on either the top portion, the bottom portion, or both for adding additional decorative elements.

VII. Sixth Embodiment Interior Decorating Kit 252

Figure 15:
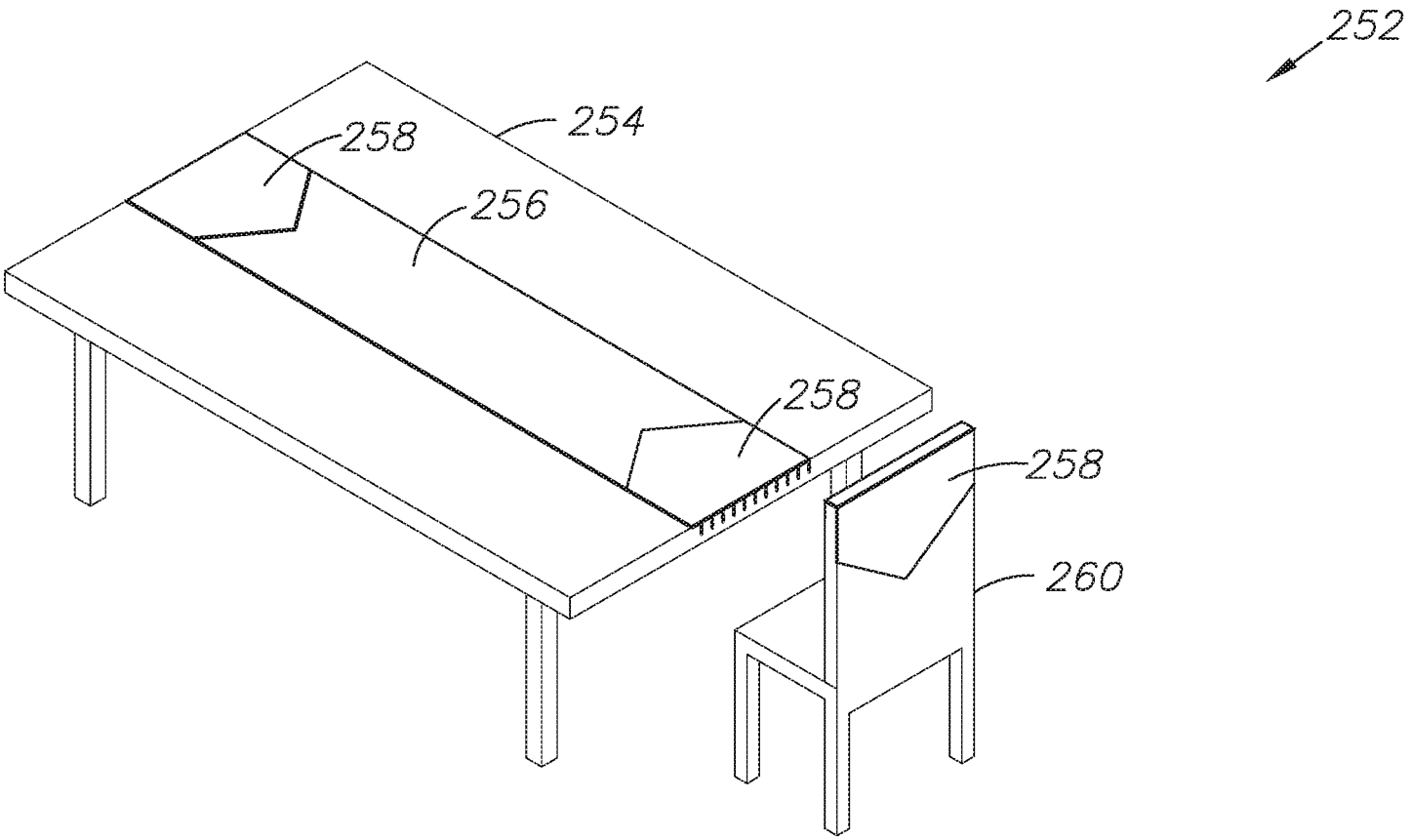
FIG. 15 is a three-dimensional isometric view of yet another alternative embodiment of the present invention featuring a table runner and chair back.

As shown in FIGS. 15, a sixth embodiment interior decorating kit 252 can be associated with tables 254 and/or chairs 260. A table runner 256 has detachable/interchangeable extensions 258 or end pieces that can be used to accommodate expansion when adding table leaves, or merely for decorative flair. If a table is extended using leaves, the attachments 258 can be used simply to expand the coverage of the runner 256. In addition, another detachable/interchangeable fabric can be attached to the reverse side of the table runner therefore, providing up to three (3) alternative designs. These same extensions 258 could be used on the backs of chairs 260 to match the table runner 256. As above, these extensions 258 could also include connection areas for attaching additional decorative elements, such as shown in FIGS. 8-10. A similar embodiment could be used as a bed runner or decoration.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A home interior decorating kit comprising:

a first home interior item and a second home interior item, each of said first and second home interior items comprised at least partially of cloth, and each of said at least two home interior items including a primary connector;

a first decorative attachment comprised at least partially of cloth, said first decorative attachment having a first length and comprising a secondary connector configured to be semi-permanently attached to said primary connector of said first home interior item;

a second decorative attachment comprised at least partially of cloth, said second decorative attachment having a second length and comprising a secondary connector configured to be semi-permanently attached to said primary connector of said second home interior item;

each of said first and second decorative attachments including dangling ornamentation semi-permanently affixed to at least one edge of a respective attachment, wherein said first length of said first decorative attachment and said second length of said second decorative attachment include said dangling ornamentation;

said first home interior item comprising a tissue roll holder, said tissue roll holder comprising a box having an opening and a decorative cloth covering affixed to an exterior face of said box, said decorative cloth comprising a pair of detachable folding side panels and a cover body, said pair of detachable side panels each including a side panel connector configured to connect with a respective one of a pair of cover body connectors;

wherein a respective one of said plurality of decorative attachments comprising a first attachment is semi-permanently affixed to a first of said at least two home interior items;

wherein said first and second decorative attachments are selectively removable from said first and second home interior items respectively;

wherein said first attachment and said second attachment are further configured to be swapped between said first said first and second two home interior items;

whereby said first home interior item has a base length extended by said first length of said first decorative attachment; and whereby said second home interior item has a base length extended by said second length of said second decorative attachment.

2. The home interior decorating kit of claim 1, further comprising:

wherein said first connector and said second connector are comprised of a connector selected from the list comprising: snaps; magnets; hooks; eyes; zippers; buttons; and hook-and-loop fasteners; and wherein said second home interior item comprises a curtain; and wherein said first decorative attachment is configured to lengthen said curtain by said first length.

3. The home interior decorating kit of claim 1, further comprising:

each of said plurality of decorative attachments including a pattern unique amongst said plurality of decorative attachments.

4. The home interior decorating kit of claim 1, further comprising:

said dangling ornamentation of said first decorative attachment is selectively removable; and wherein said first length of said first decorative attachment configured to be adjusted upon selectively removing said dangling ornamentation.

5. The home interior decorating kit of claim 1, further comprising:

wherein a first interior item of said at least two home interior items comprises a table runner placed on a table;

wherein a second interior item of said at least two home interior items comprises a chair back placed on a chair;

wherein a first decorative attachment of said plurality of decorative attachments comprises a table runner extension;

wherein a second decorative attachment of said plurality of decorative attachments comprises a chair back attachment; and a table leaf configured to extend said table, whereby said first decorative attachment is configured to extend said first interior item such that said first interior item and said first decorative attachment cover said table and said table leaf.

6. The home interior decorating kit of claim 1, further comprising:

wherein a selected one interior item of said at least two home interior items comprises a window shade;

wherein a selected one decorative attachment of said plurality of decorative attachments comprises a window shade extension;

wherein a rear face of said window shade includes said first connector along a bottom edge thereof; and wherein a front face of said window shade extension includes said second connector in proximity with a top edge thereof.

7. The home interior decorating kit of claim 1, further comprising:

said second home interior item comprising a pillow;

a third home interior item comprising a curtain having a primary connector;

a third decorative attachment comprised at least partially of cloth, said third decorative attachment having a second length and comprising a secondary connector configured to be semi-permanently attached to said primary connector of said curtain; and wherein said first decorative attachment, said second decorative attachment, and said third decorative attachment are all configured to be selectively removed from their respective first, second, and third home interior items and selectively placed onto a different one of said first, second, and third home interior items.

8. A method of decorating with home interior items, the method comprising the steps:

providing a first home décor item comprised at least partially of cloth, said first home décor item including a primary connector;

said first home décor item comprising a tissue roll holder, said tissue roll holder comprising a box having an opening;

covering said first home décor item with a covering comprising a primary body and a pair of folding detachable side panels, folding said pair of folding detachable side panels against said primary body and securing said folding detachable side panels against said primary body with panel connectors;

providing a second home décor item comprised at least partially of cloth, said first home décor item including a primary connector;

providing a plurality of decoration attachments each comprised at least partially of cloth;

placing said first home décor item;

placing said second home décor item;

connecting a first decoration attachment of said plurality of decoration attachments to said first home décor item by connecting a secondary connector of said first decoration attachment to said primary connector of said first home décor item, said first decoration attachment having a first length;

connecting a second decoration attachment of said plurality of decoration attachments to said second home décor item by connecting a secondary connector of said second decoration attachment to said primary connector of said second home décor item, said second decoration attachment having a second length;

removing said first decoration attachment from said first home décor item;

removing said second decoration attachment from said second home décor item;

connecting a third decoration attachment of said plurality of decoration attachments to said first home décor item by connecting a secondary connector of said third decoration attachment to said primary connector of said first home décor item, said third decoration attachment having a third length, and thereby adjusting a total length of said first home décor item by the difference between said first length and said third length; and connecting a fourth decoration attachment of said plurality of decoration attachments to said second home décor item by connecting a secondary connector of said fourth decoration attachment to said primary connector of said second home décor item, said fourth decoration attachment having a second length, and thereby adjusting a total length of said second home décor item by the difference between said second length and said fourth length.

9. The method of claim 8, further comprising the steps:

providing a second home décor item comprised at least partially of cloth, said first home décor item including a fourth connector; and connecting a third decoration attachment of said plurality of decoration attachments to said second home décor item by connecting a fifth connector affixed to said third decoration attachment to said fourth connector.

10. The method of claim 8, further comprising the steps:

providing a second home décor item comprised at least partially of cloth, said first home décor item including a fourth connector; and connecting said first decoration attachment to said second home décor item by connecting said second connector to said fourth connector.

11. The method of claim 9, wherein said second home décor item comprises a curtain.

* * * * *